United States Patent [19]

Corrie

[11] Patent Number: 4,735,383

[45] Date of Patent: Apr. 5, 1988

[54] COMMUNICATING VITAL CONTROL SIGNALS

[75] Inventor: John D. Corrie, Chippenham, Great Britain

[73] Assignee: Westinghouse Brake and Signal Company Limited, Great Britain

[21] Appl. No.: 81,410

[22] Filed: Aug. 4, 1987

[30] Foreign Application Priority Data

Aug. 16, 1986 [GB] United Kingdom ..... 8620002

[51] Int. Cl.[4] ..... B61L 3/02

[52] U.S. Cl. ..... 246/3; 246/122 R; 246/167 R

[58] Field of Search ..... 246/2 R, 2 S, 3, 28 R, 246/122 R, 167 R, 187 B; 104/295, 299, 301

[56] References Cited

U.S. PATENT DOCUMENTS

| | | | |
|---|---|---|---|
| 3,888,437 | 6/1975 | Birhin | 246/122 R X |
| 3,937,432 | 2/1976 | Birhin | 246/187 B |
| 4,015,082 | 3/1977 | Matty et al. | 246/187 B X |
| 4,040,053 | 8/1977 | Olsson | 246/122 R X |

*Primary Examiner*—A. Michael Chambers
*Assistant Examiner*—John C. Fox
*Attorney, Agent, or Firm*—Nilsson, Robbins, Dalgarn, Berliner, Carson & Wurst

[57] ABSTRACT

A railway vehicle control system comprises a railway track (1) and a plurality of transponders (N, N+1, N+2) at predetermined positions along the track. A railway vehicle (2) moves along the track, the vehicle having means (20, 21) for detecting each of the transponders. A control location has means (4, 5, 6, 7, 7*a*) for periodically transmitting vital safety signalling information to the vehicle via a radio link. In response to detection of one of the transponders, the vehicle sends a first message via the link to the control location and in response to reception of the first message by the control location, the vital safety signalling information is sent a first time from the control location to the vehicle via the link, then from the vehicle to the control location via the link and then a second time from the control location to the vehicle via the link.

4 Claims, 3 Drawing Sheets

COMMUNICATING VITAL CONTROL SIGNALS

The present invention relates to communicating vital control signals, more particularly to a railway vehicle control system for communicating such signals.

Radio has been used for safe control of railway vehicles on lightly used tracks where, to ensure safety, formal procedures have been laid down involving highly redundant verbal communication. More recently, the exchange of vital information has been speeded up by implementing "safe" electronic processor systems in which the information is exchanged as a digital data message much more quickly than in a speech system.

In traditional railway signalling systems, vital signalling information which gives a train authority to proceed through a following track section, was conveyed visually using movable semaphore signals and, in latter days, electrically lit coloured signal lamps.

On main lines, away from stations, intersections, etc., track sections are about 1 km long so that traditionally the visual signals are spaced at intervals of approximately 1km. A modern high speed train travelling at 200 k.p.h. covers this distance in approximately 18 seconds. The control or supervisory system must, therefore, be capable of completing all signalling information exchanges with supervised vehicles within this time period. In order to keep the radio network simple it is preferred to use a single radio channel but the length of conventional signalling messages imposes a severe restriction upon the number of trains which may be supervised simultaneously. This kind of system is useful on route networks carrying only light traffic but is generally unsuitable for main lines carrying a lot of traffic. The maximum density of radio traffic may be increased by using a plurality of radio channels and/or by using a cellular radio system. However, these solutions lead to increases in complexity and cost of radio equipment carried by each vehicle.

According to the present invention, there is provided a railway vehicle control system comprising:

(a) a railway track;

(b) a plurality of marking means at predetermined positions along the track;

(c) a railway vehicle which moves along the track, the vehicle having means for detecting each of the said marking means; and (d) a control location having means for periodically transmitting vital safety signalling information to the said vehicle via a communication link, the system being such that:

(i) in response to detection of one of the said marking means, the vehicle sends a first message via the said link to the said control location;

(ii) in response to reception of the said first message, the control location sends to the vehicle, via its transmitting means and the said communication link, a second message comprising the said vital safety signalling information;

(iii) in response to reception of the said second message, the vehicle sends a third message comprising the said vital information, via the said link to the said control location; and (iv) in response to reception of the said third message, the control location sends to the vehicle, via its transmitting means and the said link, a fourth message comprising the said vital information.

The present invention will now be described, by way of example, with reference to the accompanying drawings, in which.

Figure 1:
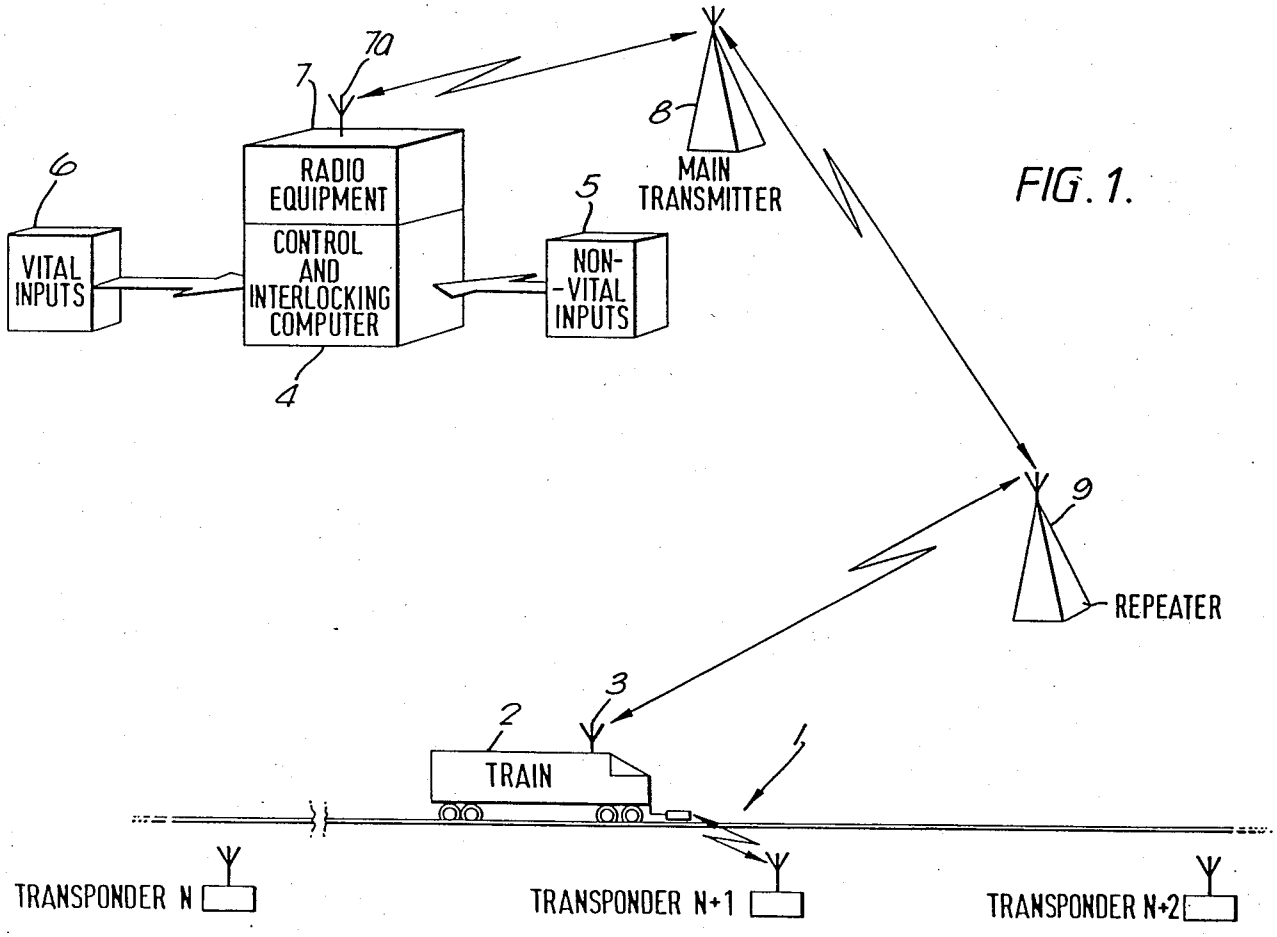
FIG. 1 is a schematic diagram of a railway vehicle control system.

Referring first to FIG. 1, a stretch of railway is indicated at 1, a train is indicated at 2 and a plurality of transponders are positioned at intervals spaced apart along the length of the track 1. In the drawing, these transponders are given the references "N", "N+1" and "N+2". The train 2 is fitted with radio equipment, shown in more detail in FIG. 2, having an aerial 3.

In a control station or control centre there is a control and interlocking computer generally indicated at 4, which receives a plurality of non-vital inputs, via a block 5, and a plurality of vital inputs, via a block 6. The control data outputs generated by the control and interlocking computer 4 are connected at the control station or control centre to radio communication equipment 7 having an aerial 7*a*, for transmission by radio to the aerial 3 of the radio equipment carried by train 2.

In order to provide adequate geographical coverage of the complete track network under the control of the control and interlocking computer 4, signals from the computer 4 are sent from the radio equipment 7 and aerial 7*a* to a main transmitter 8 and over a radio link including repeater stations, such as at 9.

The control data outputs generated by the computer 4 are produced serially. The radio link is a single channel link and therefore can only give new signalling data to one train at a time. Thus, to ensure that one radio channel can communicate with as many trains as possible, individual messages must be kept as short as possible, and, since signalling aspect data may be described by a few data bits only, this is possible providing those few data bits can be transmitted safely to the train. To transmit the signalling data messages safely over a single radio channel, a handshake exchange principle is adopted. For practical purposes an ASCII data format is used and that data is transmitted at a rate of 1,200 baud.

Radio communication channels are susceptible to interference which can seriously degrade reception quality and cause loss of the signalling data To overcome this, communication between a train and the control station is established according to a protocol which allows several attempts to establish communication, so as to obviate the effect of short bursts of interference. If interference is persistent over longer periods of time, so that reliable communication can not be established, then train safety procedures may be implemented.

Figure 3:
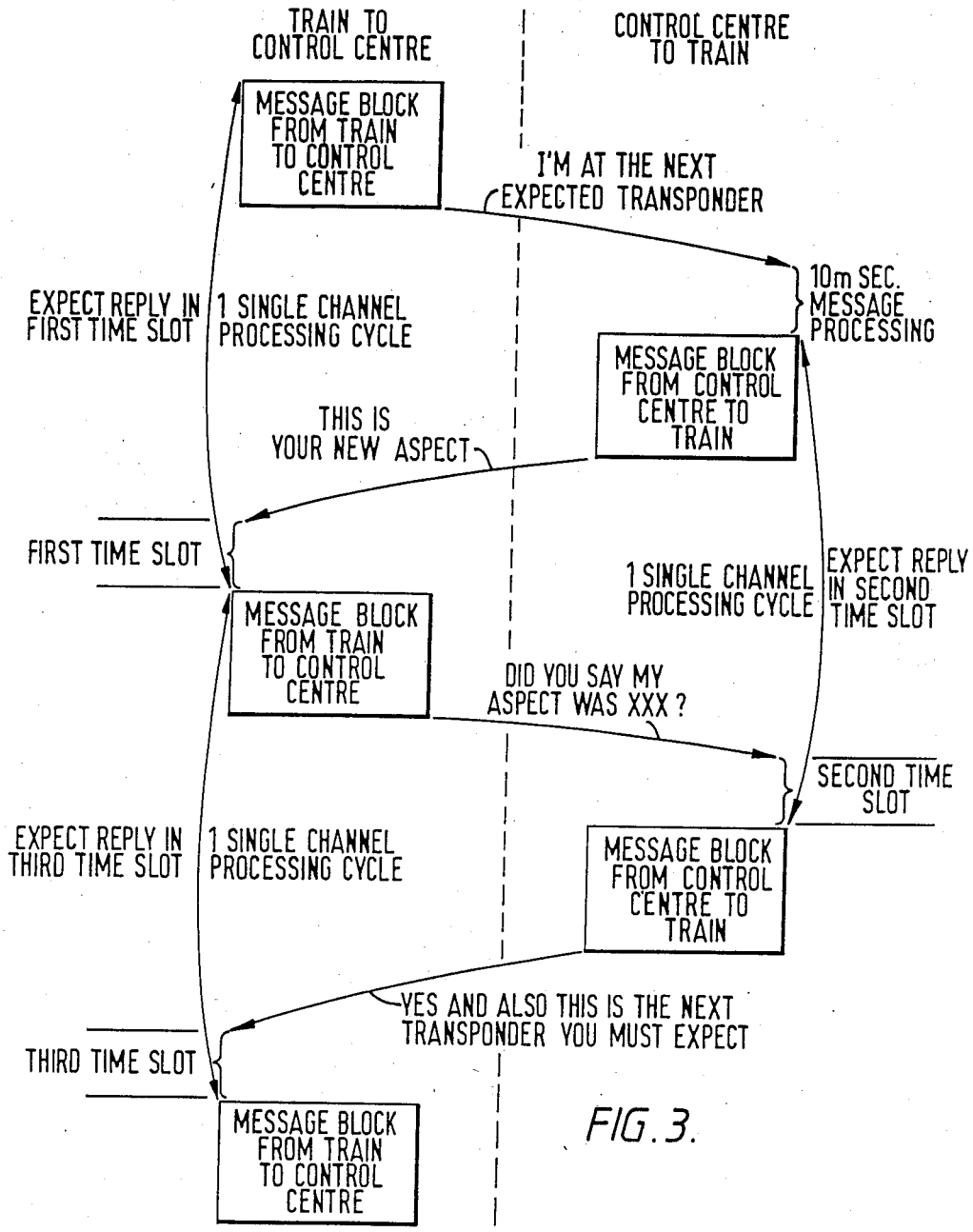
FIG. 3 shows in diagrammatic form the steps involved in a sequence of messages between a control centre and a vehicle.

The handshake principle of establishing communication is illustrated in FIG. 3, which relates to the manner in which vital information is checked in the train radio cab signalling system (which could be based on the system described in published British Patent Application Ser. No. 2,151,385.). Briefly, for the purposes of present understanding, it is sufficient to know that a multiplicity of passive transponders are located alongside the railway track at intervals spaced apart by the lengths of relay signalling track sections. Each transponder may be duplicated as a pair, each pair defing a boundary between adjacent track sections. Each transponder has a unique identity code and a passing train interrogates the transponder to discover its identity.

Having identified a transponder, the interrogating train transmits the code to the control centre or station which replies by providing the train with signalling aspect information (or speed information for automatic train protection (ATP) purposes), and also sufficient information enabling the train to identify the next transponder it must expect to encounter. It is necessary to ensure that this signalling aspect information (or speed information) is correctly received and decoded by the train. As with conventional signalling systems using coloured aspect lamps, or even semaphore signals, the object of the signalling information is to maintain a minimum headway distance behind a train separating it from the following train.

It is convenient to refer to the signalling information by the corresponding colour of a conventional signalling aspect. Therefore, a red aspect is "displayed" at the entry into the track section immediately behind a train, in the section behind that there is displayed a "yellow" aspect, behind that a "double yellow" aspect may be displayed, depending upon the system adopted, and behind that a "green aspect".

In the system referred to, a train is provided with information to identify the transponder it may expect to encounter next. The train is fitted with means for sensing and interrogating transponders. On passing a transponder, the train interrogates it and discovers its unique identity code which is then transmitted to the control centre or station via a radio link. The transponder identity code is fed into the control and interlocking computer as vital input data, and the computer checks the position of the train and determines whether it is safe for it to proceed into the next section of track, and at what maximum speed having regard to occupancy of the track section ahead of the train and possible conflicting train routes.

The train initiates an exchange of communication with the control centre or station. At the commencement of this exchange the train may identify itself by adding to the vital information its own train identity code. However, in the interests of maintaining minimum message lengths it is preferred to transmit only the vital data. This vital data (which includes train location, i.e. the identity of a detected transponder) is encoded in accordance with a first encoding scheme. The control centre or station replies by transmitting to the train, for the first time, vital data describing new signalling aspects encoded according to the first encoding scheme. The train receives and decodes this first transmission from the control centre or station and extracts the signalling data. This signalling data is temporarily stored, for later comparison, and is re-encoded according to a second encoding scheme and is transmitted back to the control centre or station to commence the second half of the double handshake cycle.

Upon receiving the re-transmitted vital data, the control centre or station decodes the data and checks it for correctness against the original data and, assuming it is correct, re-encodes it according to a third encoding scheme and re-transmits it back to the train. At this stage the control centre or station may also add, as non-vital data, sufficient information to enable the train to identify the next transponder.

Figure 2:
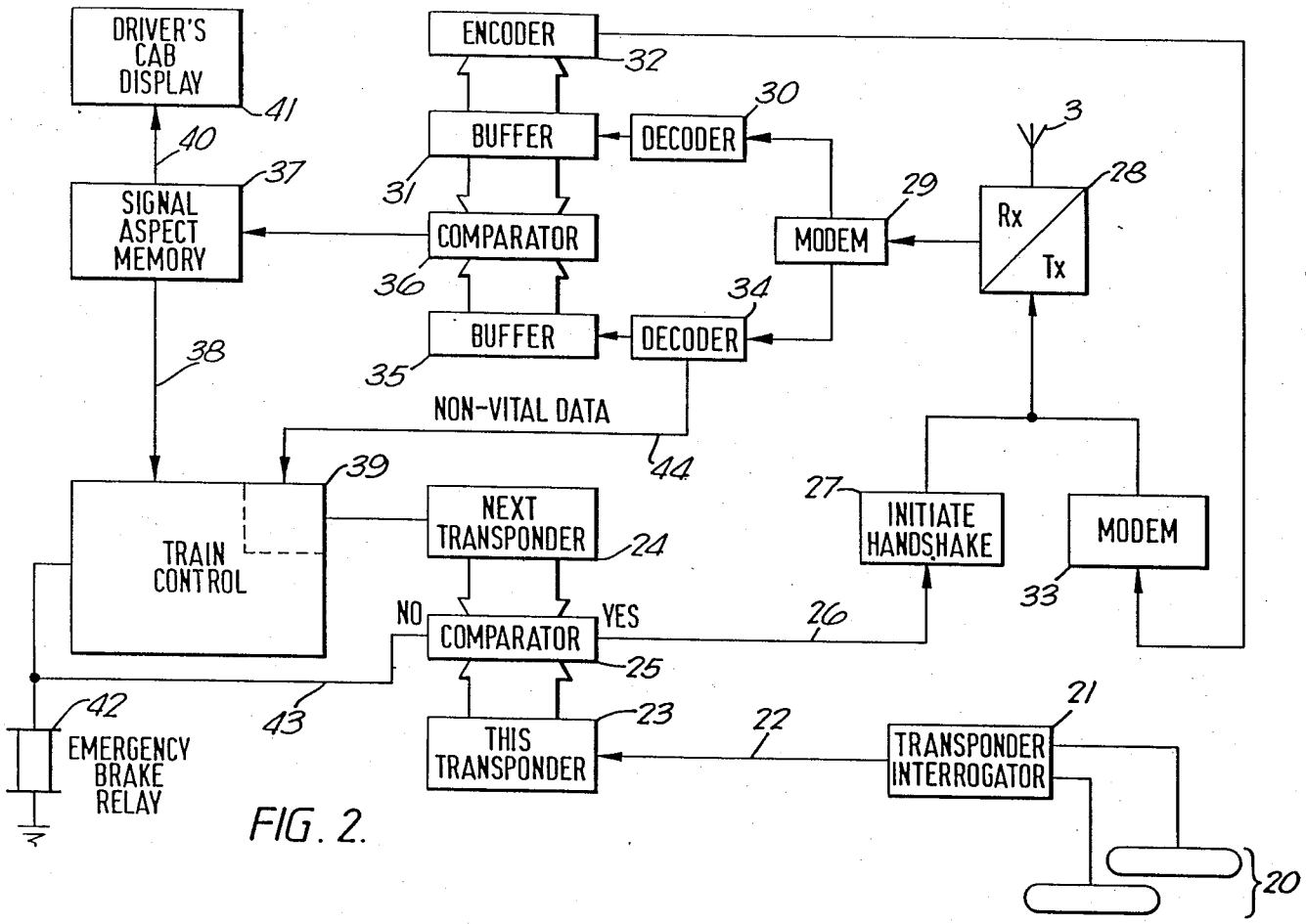
FIG. 2 is a block diagram of circuitry carried on a vehicle.

FIG. 2 is a block diagram of the train carried apparatus used in the presently described embodiment of the invention. Antennae 20 are carried towards the front of the train for the purpose of interrogating transponders on the track side or the track bed. There are a plurality of such antennae according to the variety of "types" of transponders to be interrogated. For example, in one particular arrangement the transponders may be arranged either on the left side or on the right side of the track. In this case there are two antennae 20, one arranged on the left side and the other on the right side of the train in order to closely couple with the corresponding transponders.

The antenna 20 are connected to corresponding duplex terminals of a transponder interrogation circuit 21. This circuit 21 normally occupies a "listening" mode, listening through both antennae 20 for a transponder signal. The transponders, which are passive, respond by reflecting the interrogating signals modified by their own unique identity codes when energised by signals radiated from the antennae 20. Upon sensing a transponder signal the circuit 21 extracts the unique identity code and, on signal path 22, passes this to the train control equipment.

The transponder identity code is temporarily stored in a memory 23 labelled "This Transponder". A second transponder code memory 24 acts as a temporary store for the identity code of the "Next Transponder" which the train is expected to encounter. The contents of these two memories 23 and 24 are compared by a comparator 25. If the result of the comparison is positive (i.e. the contents are the same) an output (YES) is produced on a signal path 26 connected to the input of an iniate handshake circuit 27 connected to one input of radio equipment 28. If the comparison is positive, a circuit 27 initiates a radio transmission by the train to the control centre or station via the radio link. The transmission reception protocol allows a plurality of attempts, typically three, to establish communication. The radio equipment 28 is of the duplex type for two-way communication.

Assuming contact is established with the control centre or station, communication proceeds according to the safety criteria illustrated in FIG. 3.

The first return signal from the control centre or station containing the new signal aspect is routed by a modem 29 to a first decoder circuit 30 which decodes the received signal according to the first encoding scheme. The decoded output is loaded into a temporary buffer memory 31. The contents of memory 31 are read by an encoder circuit 32 which re-encodes the data according to the second encoding scheme. The output of encoder 32 is connected to a further modem circuit 33 connected to the input of the radio equipment 28. The resulting transmitted signal constitutes the second transmission from the train to the control centre or station.

In response to the second transmission, the control centre or station re-transmits the signal aspect, this time encoded according to the third encoding scheme. When this re-transmission is received at the train, it is routed by the modem 29 to a further decoder circuit 34 which decodes the signal according to the third encoding scheme. The signal aspect output is loaded into a further buffer memory 35.

Assuming there have been no errors or interference during transmission and decoding, the two buffer memories 31,35 should contain the same decoded data. Their contents are compared by a comparator 36 and if positive comparison is established, the signal aspect data is loaded into a memory 37 which provides an input on a line 38 to train control apparatus generally indicated at 39, and a second input on a line 40 to drive a driver's cab display 41.

In the final transmission from the control centre or station to the train, in addition to the signal aspect data, the control centre or station also informs the train of the identity code of the next transponder it can expect to encounter. This is non-vital data and is therefore transmitted only once. This non-vital data is recognised by the third decoder circuit 34 and is sent via a non-vital data output 44 to the train control apparatus 39 which loads the transponder identity code into the "next" transponder memory 24 in preparation for identification of the next encountered transponder.

The train control apparatus 39 has control over an emergency brake system. For example, in the presently described embodiment the emergency brake system is held in a non-actuated state by an emergency brake relay 42. As long as relay 42 is maintained energised the emergency brake system is non-actuated. However if certain safety conditions are not fulfilled, the relay 42 is de-energised to bring about an emergency brake application. Sometimes it is preferred to give a driver warning instead of emergency brake application, to avoid bring the train to a halt in a tunnel for example. In the system described above the relay 42 is also arranged to be de-energised as a result of a negative (NO) output from the comparator 25 on line 43 (meaning that the contents of memories 23 and 24 are different). That is, an emergency brake application is brought about if the identity code of an encountered transponder, as loaded into memory 23, does not correspond to the identity code contained in memory 24 of the next expected transponder.

The invention may be applied more widely than in radio communication systems. It may be used, for example, in connection with fibre optic communication systems in which case those parts of the above described equipment particular to radio communication systems will be omitted, and substituted by suitable items necessary for generating, transmitting and receiving optical signals.

I claim:

1. A railway vehicle control system comprising:

(a) a railway track;

(b) a plurality of marking means at predetermined positions along the track;

(c) a railway vehicle which moves along the track, the vehicle having means for detecting each of the said marking means; and (d) a control location having means for periodically transmitting vital safety signalling information to the said vehicle via a communication link, the system being such that:

(i) in response to detection of one of the said marking means, the vehicle sends a first message via the said link to the said control location;

(ii) in response to reception of the said first message, the control location sends to the vehicle, via its transmitting means and the said communication link, a second message comprising the said vital safety signalling information;

(iii) in response to reception of the said second message, the vehicle sends a third message comprising the said vital information, via the said link to the said control location; and (iv) in response to reception of the said third message, the control location sends to the vehicle, via its transmitting means and the said link, a fourth message comprising the said vital information.

2. A system according to claim 1, wherein the said second, third and fourth messages comprise the said vital safety signalling information encoded according to first, second and third encoding schemese respectively.

3. A system according to claim 1, wherein the said fourth message includes an indication of the next marking means to be detected by the said detecting means of the vehicle.

4. A system according to claim 1, wherein the said communication link is a radio link.

* * * * *